United States Patent [19]

Phipps et al.

[11] Patent Number: 4,694,960

[45] Date of Patent: Sep. 22, 1987

[54] TEAR OPEN BLISTER PACKAGE

[75] Inventors: Cornelius M. Phipps, Glen Ellyn; William C. Pershak, Chicago, both of Ill.

[73] Assignee: Plastic Specialties, Inc., Glen Ellyn, Ill.

[21] Appl. No.: 879,054

[22] Filed: Jun. 26, 1986

[51] Int. Cl.[4] ..... B65D 75/58

[52] U.S. Cl. ..... 206/469; 206/613; 206/615

[58] Field of Search ..... 206/461, 469, 604, 605, 206/607–615, 620, 630, 633, 634

[56] References Cited

U.S. PATENT DOCUMENTS

| | | | |
|---|---|---|---|
| 2,793,745 | 5/1957 | Cox, Jr. | 206/469 |
| 3,165,234 | 1/1965 | Conklin et al. | 206/469 |
| 3,302,818 | 2/1967 | Balocca et al. | 206/633 |
| 3,550,764 | 12/1970 | Tigner | 206/605 |
| 4,318,479 | 3/1982 | Lisiecki | 206/633 |
| 4,410,089 | 10/1983 | Bortolani | 206/633 |
| 4,638,911 | 1/1987 | Prohaska | 206/611 |

FOREIGN PATENT DOCUMENTS

| | | | |
|---|---|---|---|
| 0116523 | 2/1943 | Australia | 206/613 |
| 0876743 | 4/1953 | Fed. Rep. of Germany | 206/613 |

*Primary Examiner*—Jimmy G. Foster

*Attorney, Agent, or Firm*—Lee, Smith & Zickert

[57] ABSTRACT

A tear open blister package of the type having a blister receptacle formed of plastic which has a periperhal flange secured to a flat backing. A tab extends from the receptacle at the flange for grasping during opening of the package, with the tab being unsecured to the backing. A tear initiation cut is provided in the plastic material of the receptacle at the intersection of the tab with the flange for initiating tearing of the plastic material.

20 Claims, 8 Drawing Figures

TEAR OPEN BLISTER PACKAGE

BACKGROUND OF THE INVENTION

This invention relates to plastic display packages commonly designated blister packages, in which a plastic blister receptacle is secured to a generally flat backing member. In particular, this invention relates to such a package having means for easily tearing the plastic blister receptacle for gaining access to the contents of the package.

Plastic blister packages, also known as bubble packages, have been in long and extensive use for packaging and display of a wide variety of products. The package is composed of two primary components, a stiff backing, usually of cardboard, and a thermoformed blister receptacle having a peripheral flange which is bonded in some manner to the backing. The blister receptacle is shaped to fit over and cover articles that are to be contained within the package. It is usually formed of transparent plastic film so that the contents of the package may be viewed.

While such blister packages are relatively inexpensive, gaining access to the contents has proven quite difficult. The plastic blister is almost impossible to open wihout a sharp knife to cut into the plastic material and remove at least a sufficient part of the blister as to make it possible to remove the contents. The edge of the plastic blister is extremely difficult to tear manually, and normally the plastic material remains intact. If the backing is cardboard, the backing is, on occasion, perforated so that the contents may be removed through the cardboard backing. Often the perforations are inadequate to permit access to the contents of the package without some object to assist tearing of the backing along the perforation. If the perforation is too pronounced, during shipping and handling, the package can inadvertently be opened. Thus, perforation of the backing has found some utility, although limited.

Other suggestions for gaining entry to the blister receptacle have been made. For example, U.S. Pat. Nos. 4,119,203; 4,210,246; 4,266,666 and 3,942,690 has suggested various structures in which the blister is bodily separated or removed from the backing. The blister receptacle itself is not cut or torn during the removal process. U.S. Pat. No. 4,191,293 is similar to these patents, and also provides a separate tab to help remove the blister from its backing. Again, the blister is not torn or cut.

U.S. Pat. No. 2,793,745 discloses a package composed of a plastic blister secured to a backing. A tab is provided to permit rendering of the plastic material of the blister along a pre-formed score line. While the plastic of the blister is separated, there is no means in this patent of providing a starting point of weakness to initiate tearing along the score line.

SUMMARY OF THE INVENTION

The present invention provides an improved package of the type having a generally flat backing and having a blister receptacle formed of plastic which has a peripheral flange which is secured to the backing. In accordance with the invention, a tab is provided extending from the receptacle at and intersecting the flange, with the tab being unsecured to the backing. A tear initiation cut through the plastic material of the receptacle at the intersection of the tab and the flange is provided for initiating tearing of the plastic material when access to the contents of the package is desired. The plastic material therefore is irreparably rendered during the opening process.

In accordance with the preferred form of the invention, the tab comprises an integral extension of the plastic material of the receptacle. If desired, more than one tab can be provided for rendering the plastic at certain locations of the blister, and the tabs can be located adjacent one another so that a significantly large opening can be provided than were a single tab employed.

To facilitate one's grip on the tab, various means of grip enhancement can be formed in the tab. In accordance with the primary embodiment of the invention, the grip enhancement comprises a series of adjacent ribs. The tab may be otherwise structured, as by perforations, roughening of its surface, and other similar means.

A tear initiation cut is preferably at each side of the tab in order that simultaneous rendering of the plastic material of the blister occurs when the tab is pulled. Each of the cuts comprises a slit which extends into at least an edge portion of adjacent flange of the receptacle.

In some instances, tearing away of a particular portion of the plastic material is desired. In those instances, a tear guide is provided extending from the cut, the tear guide preferably comprising a lineal bead in the receptacle. To ensure the tearing proceeds along the tear guide, the plastic material of the bead is of a lesser thickness than the adjacent plastic material so that once tearing has begun, it naturally follows the line of lesser thickness of the lineal bead. As many beads as cuts are provided in the blister receptacle. If a single tab is provided, two beads are provided extending from its two tear initiation cuts. If two adjacent tabs are provided, three beads extending from the cuts of the tabs are provided, and so on.

BRIEF DESCRIPTION OF THE DRAWING

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
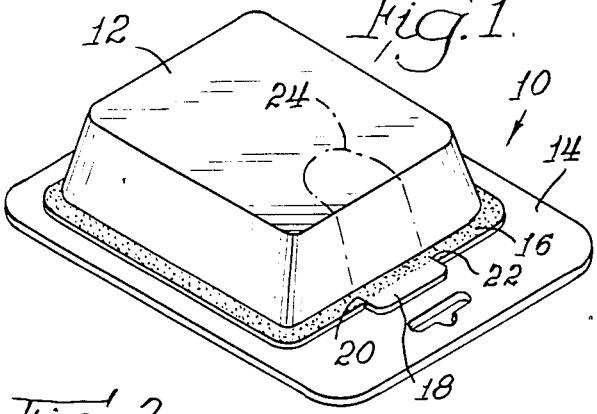
FIG. 1 is a perspective view of one form of the invention.

A package according to the invention is designated at 10 in each of the drawing figures. While each of the packages 10 of the various drawing figures vary in detail as described at length below, basic components of each of the packages 10 include a blister receptacle 12 which is affixed to a generally flat backing 14. As is quite common with such packages, the blister receptacle 12 may be formed of a clear plastic material, while the flat backing 14 may comprise a stiff material, such as cardboard. The blister receptacle 12 is thermoformed in a conventional fashion. It is shaped to fit over the article or articles (not illustrated) which are contained in the package 10, and therefore the particular shape of the package 10 shown in the various drawing figures is illustrative only, the possible shapes of the blister receptacle being virtually limitless.

The receptacle 12 is provided with a peripheral flange 16 which is secured to the flat backing 14 in a conventional manner, such as by heat sealing, adhesive, or otherwise. The sealing between the flange 16 and the backing 14 is shown in a stippled fashion in the drawing figures. The flange 16 extends about the entire periphery of the receptacle 12 so that sealing can be complete in order to, for example, protect sterile contents or insure that small articles contained within the package 10 are not dispensed through some small fissure or opening.

As previously explained, in prior packages, gaining entry to the contents of the package 10 is almost impossible without a knife to cut the plastic material of the blister receptacle 12, or weakening of the backing 14 with scoring or the like to permit access through the backing itself. In accordance with the simplest version of the invention, a tab 18 is formed in the plastic material of the blister receptacle 12 extending outwardly from the flange 16. A tear initiation cut 20 and 22 is provided on either side of the tab 18 through the plastic material of the blister receptacle 12 at the intersection of the tab 18 with the flange 16. The tab 18 is not secured to the backing 14 in any manner, and when the tab 18 is grasped and lifted, tearing of the plastic material of the blister receptacle 12 initiates at the cuts 20 and 22 and extends into the body of the blister receptacle, following an irregular path such as that shown by a phantom line or path 24 in FIG. 1. The direction and extent of the tear path 24 will depend on may factors, including the thickness of the plastic material of the blister receptacle 12, the direction of force applied to the tab 18 when tearing is initiated, the constituents of the plastic material of the blister receptacle and whether it has any tearing orientation, and the shape of the blister receptacle itself.

Figure 2:
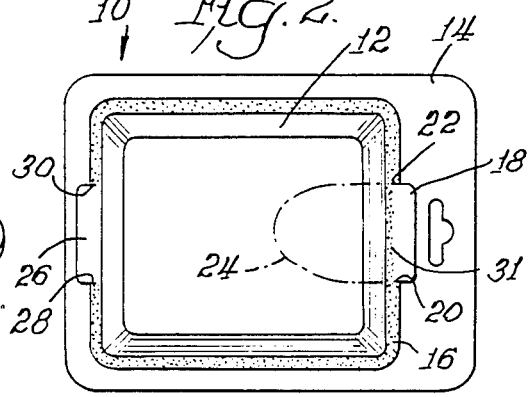
FIG. 2 is a top plan view of a package similar to that of FIG. 1, and illustrating tear initiation tabs at opposite sides of the plastic blister receptacle of the package.

In FIG. 2, a tab 18 with tear initiation cuts 20 and 22 identical to that of FIG. 1 is illustrated. In addition, a second tab 26 having tear initiation cuts 28 and 30 is provided for permitting an additional rendering of the blister receptacle 12, if desired. Also shown in FIG. 2, the portion of the flange 16 from which the tab 26 extends is depicted as unsecured to the backing 14. In some instances, omitting securing in that vicinity may be advantageous. In other instances, decreasing the securing of the flange 16 adjacent the tab 18, as by a thinner seal area 31 between the flange 16 and backing 14, may be advantageous. If not, the entire flange 16 can be secured as shown in FIG. 1.

Figure 3:
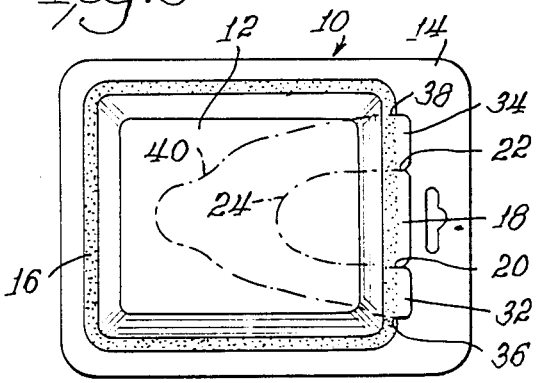
FIG. 3 is a top plan view similar to that of FIG. 2, but having a different tab arrangement.

FIG. 3 illustrates a form of the invention having, in addition to the tab 18, two further tabs 32 and 34. In a fashion identical to that described previously, additional tear initiation cuts 36 and 38 are provided through the plastic material of the receptacle 12 at the intersection of the respective tabs 32 and 34 with the flange 16. Each cut 36 and 38 comprises a slit extending into at least the edge portion of the flange 16 and promotes rendering of the plastic material of the blister receptacle 12 along a tear path 40 when the tabs 32 and 34 are grasped and pulled. Similar to the tear path 24, the tear path 40 is shown generally in FIG. 3, with the actual direction taken by the tear path 40 being dependent on many factors.

Figure 4:
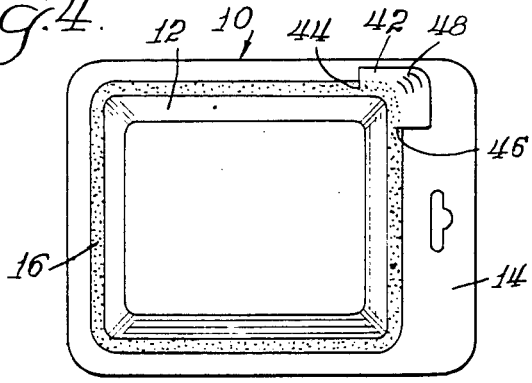
FIG. 4 is another top plan view similar to that of FIG. 2, having yet another tab arrangement in a corner of the blister package.

FIG. 4 illustrates a further embodiment of the invention having a corner tab 42. Tear initiation cuts 44 and 46 are provided adjacent the tab 42 in a fashion identical to that of the previously-described embodiments of the invention. In addition, the tab 42 is formed with a grip enhancement structure comprising a series of adjacent, raised ribs 48. Other means of grip enhancement, such as perforating the tab or roughening its surface, can also be provided.

Figure 5:
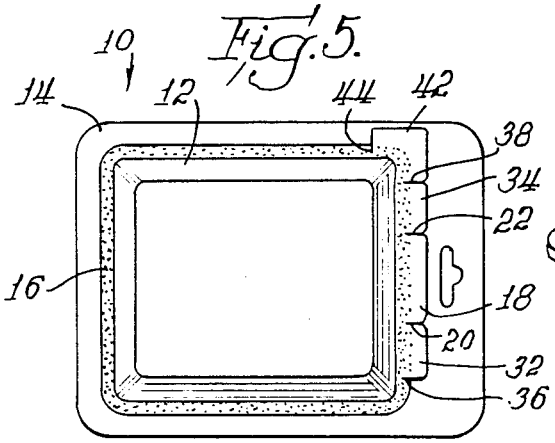
FIG. 5 is a top plan view similar to that of FIG. 2, with the combined tab arrangements of FIGS. 3 and 4.

FIG. 5 is a combination of the embodiments of FIGS. 3 and 4. It functions identically and is composed of the same elements, bearing the same reference numerals, which are described at length above.

Figure 6:
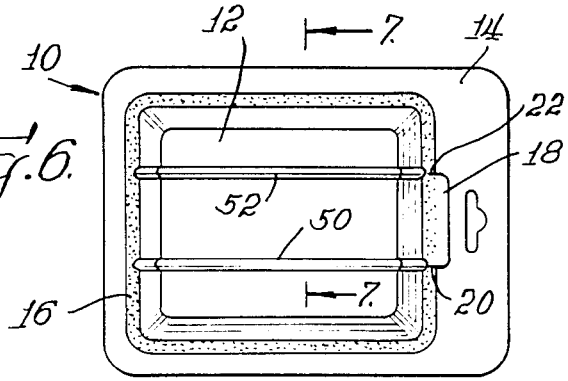
FIG. 6 is a top plan view of yet another form of the invention having a tear guide extending from the tab.
Figure 7:
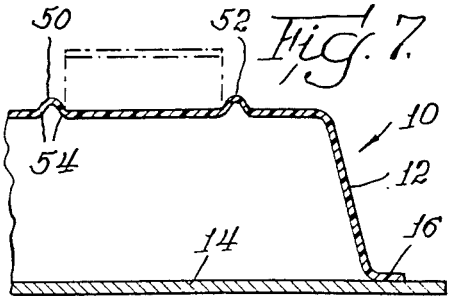
FIG. 7 is an enlarged cross-sectional view taken along lines 7—7 of FIG. 6 and illustrating in phantom a portion of the plastic material of the blister receptacle when removed.

FIGS. 6 and 7 illustrate a further embodiment of the invention employing the basic tab 18 with tear initiation cuts 20 and 22, but further including a tear guide extending from the tab 18. As best shown in FIG. 7, the tear guide comprises raised lineal beads 50 and 52 in the blister receptacle 12.

At least portions of the plastic material of the beads 50 and 52 are of a lesser thickness than the adjacent plastic material of the remainder of the blister receptacle 12. As is well known in the thermoforming industry and as described in somewhat greater detail in U.S. Pat. No. 4,512,474, the disclosure of which is incorporated herein by reference, during the thermoforming process, the shape of the blister receptacle is dictated by draping a heated plastic sheet over a mold, male or female, and then vacuum forming the heated plastic sheet to conform exactly to the mold. The plastic is in a softened state and when the plastic engages the cooler mold, the plastic hardens to the shape of the mold. Thus, turning to the receptacle shown in FIGS. 6 and 7, during the formation process, a hot sheet of plastic is draped over a male mold which is shaped to provide the desired interior shape of the blister receptacle 12. Limited areas of the plastic first contact the male mold at the peaks of the beads 50 and 52 and these areas harden upon contact. As the plastic is vacuum formed to form the tear guides 50 and 52, the plastic film along both sides of the beads stretches slightly, thus decreasing the thickness of the plastic sheet material at these locations. Thus the greatest amount of stretching, and therefore the greatest amount of consequential thinning, occurs at the valleys of the tear guides 50 and 52. Valleys 54 of the tear guide 50 are identified in FIG. 7 to illustrate those locations of maximum stretch of the thermoformed plastic, and hence minimum thickness of the blister receptacle adjacent the tear guides 50 and 52. While the dimensions possible in the drawing figures render it impossible to show relative thicknesses of the plastic material of the blister receptacle 12, that in the valleys 54 is slightly thinner so that once tearing has been initiated by lifting the tab 18 to cause initial rendering at the tear initiation cuts 20 and 22, tearing naturally follows one of valleys of each of the tear guides 50 and 52 without deviating into the adjacent material of the blister receptacle 12. Once tearing has begun in one valley of a tear guide 50 or 52, tearing will follow that valley so long as pulling force is applied to the tab 18.

While the tear guides 50 and 52 have been illustrated as raised beads in the blister receptacle 12 of FIG. 7, depressed beads or grooves, as when a female mold is used, will function in precisely the same manner. In that situation, however, the thinnest dimension of the bead would be at the bottom of the bead, and therefore tearing would proceed at that location.

Figure 8:
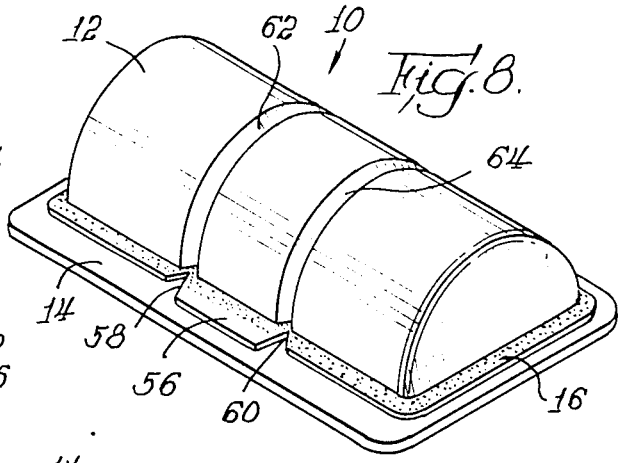
FIG. 8 is a top plan view of yet another embodiment of the invention, similar to that of FIG. 6, having a blister receptacle of a domed configuration.

FIG. 8 illustrates a further form of the invention in which the package 10 is of a domed cross section and includes a tab 56, tear initiation cuts 58 and 60, and tear guides 62 and 64. When the tab 56 is raised to initiate tearing, tearing proceeds along the tear guides 62 and 64 in an identical fashion to that described above with regard to tearing of the package 10 illustrated in FIGS. 6 and 7.

When the plastic material of the blister receptacle 12 has been rendered in any fashion illustrated in the various embodiments of FIGS. 1 through 8, if desired, the remainder of the intact receptacle 12 can by physically removed from the backing 14 by inserting a thumb or fingers into the intact receptacle and bodily pulling it from the backing 14. Otherwise, the rendered opening in the blister receptacle can be used as a dispensing opening should the contents of the package 10 so permit.

Various changes can be made to the invention without departing from the spirit thereof or scope of the following claims.

What is claimed is:

1. In a package having a generally flat backing and a blister receptacle formed of plastic material and a peripheral flange which is secured to the backing, the improvement comprising, a. tab means extending from said receptacle at and intersecting said flange for grasping during opening, said tab means being unsecured to the backing, b. a tear initiation cut through the plastic material of the receptacle at the intersection of said tab means and said flange for initiating tearing of the plastic material, and c. a tear guide extending from said cut, said tear guide comprising a lineal bead in said receptacle of a lesser thickness than the adjacent plastic material of said receptacle.

2. A package in accordance with claim 1 in which said tab means comprises an integral extension of the plastic material of the receptacle.

3. A package in accordance with claim 1 including a plurality of said tab means.

4. A package in accordance with claim 3 in which said tab means are adjacent one another.

5. A package in accordance with claim 1 including a grip enhancement structure formed in said tab.

6. A package in accordance with claim 5 in which said structure comprises a series of adjacent ribs.

7. A package in accordance with claim 1 including a said tear initiation cut at opposite sides of said tab means.

8. A package in accordance with claim 7 in which each said cut comprises a slit extending into at least an edge portion of said flange.

9. In a package having a generally flat backing and a blister receptacle formed of plastic material and a peripheral flange which is secured to the backing, the improvement comprising, a. means forming a tab extending from said receptacle at and intersecting said flange for grasping during opening, said tab means being unsecured to the backing, b. said flange being sealed to the backing, and including a seal area of the flange adjacent said tab which is thinner then the remaining seal of the flange to the backing, and c. a tear initiation cut through the plastic material of the receptacle at the intersection of said tab means and said flange for initiating tearing of the plastic material.

10. A package in accordance with claim 9 in which said tab means comprises an integral extension of the plastic material of the receptacle.

11. A package in accordance with claim 9 including a plurality of said tab means.

12. A package in accordance with claim 11 in which said tab means are adjacent one another.

13. A package in accordance with claim 9 including a said tear initiaton cut at opposite sides of said tab means.

14. A package in accordance with claim 13 in which each said cut comprises a slit extending into at least an edge portion of said flange.

15. In a package having a generally flat backing and a blister receptacle formed of plastic material and a peripheral flange which is secured to the backing, the improvement comprising, a. means forming a tab extending from said receptable at and intersecting said flange for grasping during opening, said tab means being unsecured to the backing, b. said flange being sealed to the backing, and including an area of the flange adjacent said tab which is not sealed to the backing, and c. a tear initiation cut through the plastic material of the receptacle at the intersection of said tab means and said flange for initiating tearing of the plastic material.

16. A package in accordance with claim 15 in which said tab means comprises an integral extension of the plastic material of the receptacle.

17. A package in accordance with claim 15 including a plurality of said tab means.

18. A package in accordance with claim 17 in which said tab means are adjacent one another.

19. A package in accordance with claim 15 including a said tear initiation cut at opposite sides of said tab means.

20. A package in accordance with claim 19 in which each said cut comprises a slit extending into at least an edge portion of said flange.

* * * * *